US008712309B2

(12) United States Patent
Watanabe et al.

(10) Patent No.: US 8,712,309 B2
(45) Date of Patent: Apr. 29, 2014

(54) CLEANING DEVICE, AND IMAGE FORMING APPARATUS, PROCESS CARTRIDGE, AND INTERMEDIATE TRANSFER UNIT EACH INCLUDING THE CLEANING DEVICE

(75) Inventors: Kazuhiko Watanabe, Tokyo (JP); Keiji Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 304 days.

(21) Appl. No.: 13/064,260

(22) Filed: Mar. 15, 2011

(65) Prior Publication Data

US 2011/0229233 A1 Sep. 22, 2011

(30) Foreign Application Priority Data

Mar. 18, 2010 (JP) ..... 2010-063184

(51) Int. Cl.
*G03G 21/00* (2006.01)

(52) U.S. Cl.
USPC ..... 399/350

(58) Field of Classification Search
USPC ..... 399/50, 51, 350, 351
See application file for complete search history.

(56) References Cited

U.S. PATENT DOCUMENTS

| | | | | |
|---|---|---|---|---|
| 7,369,807 | B2 * | 5/2008 | Naruse et al. | 399/351 |
| 7,383,013 | B2 | 6/2008 | Watanabe et al. | |
| 7,711,308 | B2 | 5/2010 | Hozumi et al. | |
| 2007/0242992 | A1 | 10/2007 | Watanabe et al. | |
| 2008/0063448 | A1 | 3/2008 | Hozumi et al. | |
| 2008/0286020 | A1 | 11/2008 | Watanabe et al. | |
| 2009/0010692 | A1 | 1/2009 | Hozumi et al. | |
| 2009/0123205 | A1 | 5/2009 | Watanabe et al. | |
| 2010/0061779 | A1 | 3/2010 | Okamoto | |
| 2010/0067945 | A1 | 3/2010 | Hozumi et al. | |
| 2010/0067949 | A1 | 3/2010 | Watanabe et al. | |

FOREIGN PATENT DOCUMENTS

| | | | |
|---|---|---|---|
| JP | 2001083855 | A | 3/2001 |
| JP | 3276462 | | 2/2002 |
| JP | 2007041417 | A | 2/2007 |
| JP | 2007057918 | A | 3/2007 |
| JP | 2007086202 | A | 4/2007 |
| JP | 2007248737 | A | 9/2007 |
| JP | 2009300551 | A | 12/2009 |

OTHER PUBLICATIONS

Abstract of JP 06-208323 published Jul. 26, 1994.
Abstract of JP 2007-086202 published Apr. 5, 2007.
Abstract of JP 2007-248737 published Sep. 27, 2007.
Japanese Office Action dated Jan. 17, 2014 for corresponding Japanese Application No. 2010-063184.

* cited by examiner

*Primary Examiner* — Joseph S Wong
(74) *Attorney, Agent, or Firm* — Harness, Dickey & Pierce, P.L.C.

(57) ABSTRACT

A cleaning device includes a laminated blade member including multiple layers made of materials different in permanent set value and a holding member to hold the blade member. The multiple layers include an edge layer formed of a material higher in permanent set value among the materials and a backing layer disposed against a distal surface of the edge layer. The laminated blade member includes a leading edge where an edge portion of the edge layer contacting a cleaning target is located and a trailing edge where the holding member supports the blade member. A ratio of a thickness of the edge layer to a thickness of the backing layer at the trailing end of the blade member is smaller than a ratio thereof at the leading edge of the blade member.

12 Claims, 7 Drawing Sheets

CLEANING DEVICE, AND IMAGE FORMING APPARATUS, PROCESS CARTRIDGE, AND INTERMEDIATE TRANSFER UNIT EACH INCLUDING THE CLEANING DEVICE

CROSS-REFERENCE TO RELATED APPLICATIONS

The present invention claims priority pursuant to 35 U.S.C. §119 from Japanese Patent Application No. 2010-063184, filed on Mar. 18, 2010 in the Japan Patent Office, which is hereby incorporated by reference herein in its entirety.

BACKGROUND OF THE INVENTION

1. Field of the Invention

The present invention relates to a cleaning device that removes foreign matter adhering to a surface of a surface moving member (i.e., a member having a moving surface). The present invention further relates to an image forming apparatus, such as a copier, a printer, and a facsimile machine, a process cartridge, and an intermediate transfer unit, each of which includes the cleaning device.

2. Description of the Related Art

There is a wide variety of image forming apparatuses, such as electrophotographic image forming apparatuses and inkjet image forming apparatuses, and many of which are provided with surface moving members. For example, some of the electrophotographic image forming apparatuses are provided with surface moving members including a latent image carrying member (i.e., image carrying member), such as a photoconductor drum; an intermediate transfer member (i.e., image carrying member), such as an intermediate transfer belt; and a recording medium conveying member, such as a sheet conveying belt. Further, some inkjet image forming apparatuses are provided with surface moving members including a recording medium conveying member, such as a sheet conveying belt. In general, unnecessary foreign matter adhering to a surface of such a surface moving member causes a variety of problems. Therefore, a cleaning device is used that removes the unnecessary foreign matter from the surface of the surface moving member as a cleaning target.

Related-art cleaning devices that clean a surface of the cleaning target include a cleaning device using a blade member formed by an elastic member made of, for example, urethane rubber molded into a plate shape. In such a cleaning device, the blade member is held by a holding member made of a highly rigid material, such as metal, and fixed to the fixed to the frame of the device, and one edge of the blade member is pressed against the surface of the cleaning target to remove the foreign matter adhering to the surface. Such a cleaning device is simple in configuration and low in cost, and exhibits high foreign matter removal performance, and thus is widely used.

In the cleaning device according to the blade cleaning method, it is desired to bring the blade member into contact with the surface of the cleaning target with relatively high contact pressure to obtain high removal performance. It is also desired to maintain the initial contact state of the blade member to obtain stable removal performance over time.

In a single-layer blade member, the entirety of which is made of a uniform elastic material, however, it is difficult to attain both relatively high contact pressure and maintenance of the initial contact state for the following reason.

That is, if a single-layer blade member made of an elastic material of relatively high hardness is used, an edge portion of the blade member in contact with the cleaning target has a relatively small amount of deformation, and an increase in contact area of the blade member in contact with the cleaning target is prevented. It is therefore possible to set relatively high contact pressure, and to improve the cleaning performance. In general, however, an elastic material of relatively high hardness has a relatively high permanent set value. Since the blade member is in contact with the cleaning target, with one edge thereof pressed and flexed against the surface of the cleaning target, if the blade member made of an elastic material having a relatively high permanent set value is kept in continuous contact with the cleaning target for an extended period of time, so-called loss of resilience occurs, i.e., the blade member is substantially permanently deformed in a flexed shape. As a result, the contact state of the blade member over time deviates from the initial contact state, and causes cleaning failure.

By contrast, an elastic material of relatively low hardness generally has a relatively low permanent set value. Therefore, if a single-layer blade member made of an elastic material of relatively low hardness is used, the blade member is relatively resistant to the loss of resilience even if the blade member is kept in continuous contact with the cleaning target for an extended period of time, and the initial contact state can be maintained. However, an edge portion of the blade member in contact with the cleaning target is substantially deformed. Thus, the contact area is increased, and the contact pressure is reduced. As a result, sufficient removal performance is not obtained.

Thus, as described above, in a single-layer blade member, it is difficult to attain both relatively high contact pressure and maintenance of the initial contact state, and to stably obtain high removal performance over time.

Another related-art cleaning device in known, which uses a double-layer blade member made of elastic materials mutually different in hardness. An edge layer of the blade including an edge portion that comes into contact with the cleaning target is made of a material of relatively high hardness, and a backing layer not in contact with the cleaning target is made of a material of relatively low hardness. With the edge layer of relatively high hardness, the edge portion in contact with the cleaning target has a relatively small amount of deformation, and an increase in contact area is minimized, as in the above-described single-layer blade member made of an elastic material of relatively high hardness. Accordingly, relatively high contact pressure can be set. Further, the backing layer not in contact with the cleaning target has relatively low hardness and a relatively low permanent set value. Accordingly, the blade member is more resistant to the loss of resilience than the single-layer blade member of relatively high hardness, and is capable of maintaining the initial contact state.

However, as previously described, the double-layer blade member includes the edge layer made of an elastic material of relatively high hardness and a backing layer made of a material of relatively low hardness. When the blade member is pressed and flexed against a cleaning target, not only the backing layer, which is relatively resistant to the loss of resilience, but also the edge layer, which is mounted over the entire backing layer and is relatively susceptible to the loss of resilience, is flexed. Therefore, the change over time in contact state occurs more easily than in the single-layer blade member solely of the same material as the material forming the backing layer.

SUMMARY OF THE INVENTION

The present invention describes a novel cleaning device that can maintain an initial contact state of a blade member having a laminated layer structure to obtain stable removal performance over time as compared with a blade member having a single-layer structure. In one embodiment, the cleaning device includes a laminated blade member and a holding member. The laminated blade member includes multiple layers, each of which is made of materials different in permanent set value. The multiple layers include an edge layer formed of a material higher in permanent set value than any other one of the materials of the multiple layers and a backing layer disposed against a distal surface of the edge layer. The holding member holds a distal edge of the laminated blade member. A proximal edge portion of the edge layer of the blade member is brought into contact with the moving surface of the cleaning target. The laminated blade member includes a leading edge on which the edge portion thereof is located and a trailing edge where the holding member supports the blade member. A ratio of a layer thickness of the edge layer to a layer thickness of the backing layer at the trailing edge of the blade member is smaller than a ratio of the layer thickness of the edge layer to the layer thickness of the backing layer at the leading edge of the blade member.

The ratio of the thickness of the edge layer to the thickness of the backing layer may be at its maximum at the leading edge of the blade member and gradually tapered toward the trailing edge of the holding member.

The edge layer may be formed closer to the leading edge of the blade member than to the blade holding portion.

The edge layer including the edge portion may be made of a material having a 100% modulus value in a range of approximately 6 MPa to approximately 12 MPa at a temperature of 23 degrees Celsius.

The edge layer including the edge portion may be made of a material in which the difference between maximum and minimum rebound resilience coefficient values across a temperature change range of from 0 degree Celsius to 50 degrees Celsius is approximately 30% or less.

The material forming the edge layer may have a tan δ peak temperature lower than approximately 10 degrees Celsius.

The backing layer disposed against the distal surface of the edge layer may be made of a material in which the difference between maximum and minimum rebound resilience coefficient values across a temperature change range of from 0 degree Celsius to 50 degrees Celsius is approximately 30% or less.

The backing layer disposed against a distal surface of the edge layer may be made of a material having a tan δ peak temperature lower than approximately 10 degrees Celsius.

Further, the present invention describes a novel process cartridge and that can include the above-described cleaning device. In one embodiment, the process cartridge is removably installable in an image forming apparatus and transfers, onto a recording medium, an image formed on a moving surface of a latent image carrying member. The process cartridge supports both the latent image carrying member and the above-described cleaning device as a single integrated unit.

The present invention further describes a novel intermediate transfer unit that is removably installable in an image forming apparatus. In one embodiment, the intermediate transfer unit transfers an image formed on a moving surface of an image carrying member onto a moving surface of an intermediate transfer member and then onto a recording medium. The intermediate transfer unit may support both the intermediate transfer member and the above-described cleaning device as a single integrated unit.

The present invention further describes a novel image forming apparatus. In one example, the novel image forming apparatus may include the above-described cleaning device.

Toner particles forming the image may have a shape factor SF1 in a range of approximately 100 to approximately 150.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
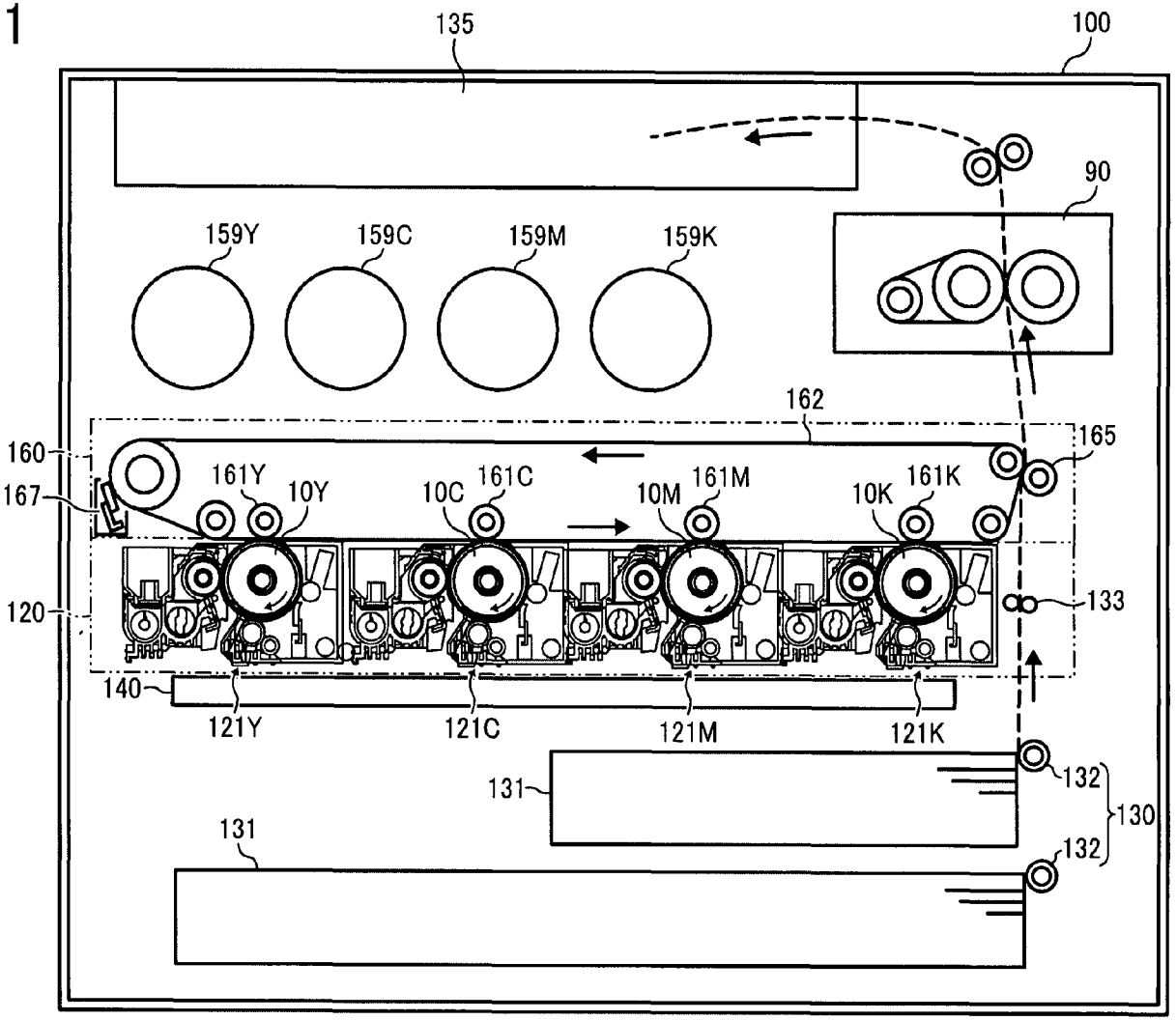
FIG. 1 is a schematic configuration diagram of a printer according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

FIG. 1 is a schematic configuration diagram illustrating a printer 100 as the image forming apparatus according to the present embodiment. The printer 100 forms a full-color image, and is configured to mainly include an image forming unit 120, a secondary transfer device 160, and a sheet feeding unit 130. In the following description, suffixes Y, C, M, and K represent members for yellow, cyan, magenta, and black colors, respectively.

The image forming unit 120 includes process cartridges 121Y, 121C, 121M, and 121K for yellow, cyan, magenta, and black toners, respectively, which are arranged in this order from the left side of the drawing. The process cartridges 121Y, 121C, 121M, and 121K (hereinafter occasionally collectively referred to as the process cartridges 121) are arranged in a substantially horizontal direction. The process cartridges 121Y, 121C, 121M, and 121K include drum-like photoconductors 10Y, 10C, 10M, and 10K (hereinafter occasionally collectively referred to as the photoconductors 10), respectively, each serving as a latent image carrying member, which is an image carrying member having a moving surface.

The secondary transfer device 160 is configured to mainly include a circular intermediate transfer belt 162, which is an intermediate transfer member stretched over a plurality of support rollers, primary transfer rollers 161Y, 161C, 161M, and 161K (hereinafter occasionally collectively referred to as the primary transfer rollers 161), and a secondary transfer roller 165. The intermediate transfer belt 162 is provided above the process cartridges 121, and extends along the moving direction of the respective surfaces of the photoconductors 10. A surface of the intermediate transfer belt 162 moves in synchronization with the movement of the respective surfaces of the photoconductors 10. Further, the primary transfer rollers 161 are arranged on the side of the inner circumferential surface of the intermediate transfer belt 162. The primary transfer rollers 161 bring the lower side of the outer circumferential surface (i.e., outer surface) of the intermediate transfer belt 162 into weak pressure contact with the outer circumferential surface (i.e., outer surface) of each of the photoconductors 10.

The process cartridges 121 are substantially the same in configuration and operation of forming a toner image on the photoconductor 10 and transferring the toner image onto the intermediate transfer belt 162. The primary transfer rollers 161Y, 161C, and 161M corresponding to three process cartridges for a color image, i.e., the process cartridges 121Y, 121C, and 121M are provided with a not-illustrated swing mechanism that vertically swings the primary transfer rollers 161Y, 161C, and 161M. The swing mechanism operates to prevent the intermediate transfer belt 162 from coming into contact with the photoconductors 10Y, 10C, and 10M when a color image is not formed.

The secondary transfer device 160 serving as an intermediate transfer unit is configured to be attachable to and detachable from the body of the printer 100. Specifically, a not-illustrated front cover provided on the near side of FIG. 1 to cover the image forming unit 120 of the printer 100 is opened, and the secondary transfer device 160 is slid from the far side toward the near side of FIG. 1. Thereby, the secondary transfer device 160 can be detached from the body of the printer 100. To attach the secondary transfer device 160 to the body of the printer 100, an operation reverse to the detaching operation is performed.

At a position on the intermediate transfer belt 162 downstream of the secondary transfer roller 165 and upstream of the process cartridge 121Y in the surface moving direction of the intermediate transfer belt 162, an intermediate transfer belt cleaning device 167 is provided to remove foreign matter, such as residual toner remaining after the secondary transfer operation, adhering to the intermediate transfer belt 162. The intermediate transfer belt cleaning device 167 supported integrally with the intermediate transfer belt 162 is configured to be attachable to and detachable from the body of the printer 100 as a part of the secondary transfer device 160.

Above the secondary transfer device 160, toner cartridges 159Y, 159C, 159M, and 159K corresponding to the process cartridges 121Y, 121C, 121M, and 121K, respectively, are arranged in a substantially horizontal direction.

Below the process cartridges 121Y, 121C, 121M, and 121K, an exposure device 140 is provided that applies laser light to the charged surface of each of the photoconductors 10Y, 10C, 10M, and 10K to form an electrostatic latent image thereon.

Below the exposure device 140, the sheet feeding unit 130 is provided. The sheet feeding unit 130 includes sheet feeding cassettes 131 for storing transfer sheets serving as recording media and sheet feeding rollers 132. The sheet feeding unit 130 may feed each of the transfer sheets at predetermined timing toward a secondary transfer nip portion, which is formed between the intermediate transfer belt 162 and the secondary transfer roller 165, via a registration roller pair 133.

On the downstream side of the secondary transfer nip portion in the transfer sheet conveying direction, a fixing device 90 is provided. On the downstream side of the fixing device 90 in the transfer sheet conveying direction, sheet discharging rollers and a discharged sheet storing unit 135 that stores a discharged transfer sheet are provided.

Figure 2:
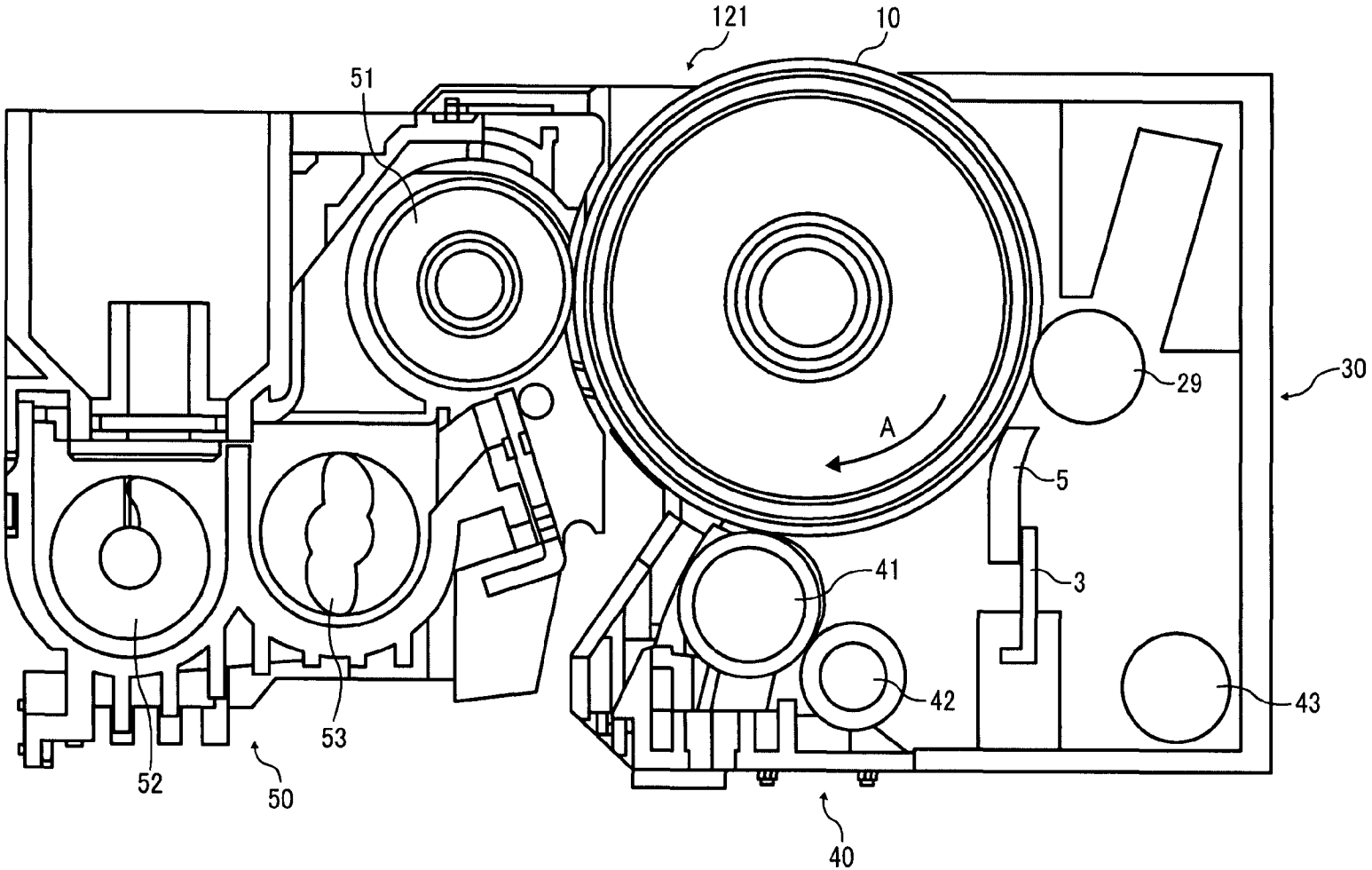
FIG. 2 is a schematic diagram of a configuration of a process cartridge provided in the printer.

FIG. 2 is a schematic configuration diagram illustrating one of the process cartridges 121 provided in the printer 100. Herein, the process cartridges 121 are substantially similar in configuration. In the following, therefore, a description will be given of the configuration and operation of the process cartridges 121, with the suffixes Y, C, M, and K for identifying the colors omitted.

The process cartridge 121 includes the photoconductor 10, and a cleaning device 30, a charging device 40, and a development device 50 arranged around the photoconductor 10.

The cleaning device 30 includes a blade holder 3, a blade member 5, which is an elastic member extending in the direction of the rotation axis of the photoconductor 10, a brush roller 29, and a discharge screw 43. In the cleaning device 30, a side (i.e., a contact side) of the blade member 5 extending in the longitudinal direction thereof, which forms an edge portion, is pressed against the surface of the photoconductor 10 to scrape off and remove unnecessary foreign matter, such as post-transfer residual toner, adhering to the surface of the photoconductor 10. Then, the brush roller 29 sweeps the foreign matter away toward the discharge screw 43 from the upstream side of the contact position of the blade member 5 in contact with the photoconductor 10 in the surface moving direction of the photoconductor 10, and the discharge screw 43 discharges the foreign matter to the outside of the cleaning device 30. In the present embodiment, conductive PET (polyethylene terephthalate) is used as a fiber material forming the brush roller 29. Detailed description of the cleaning device 30 will be given later.

The cleaning device 30 may include a lubricant application device. The lubricant application device may be configured to include a solid lubricant, a lubricant support member that supports the solid lubricant, and the brush roller 29 that rotates while in contact with both the solid lubricant and the photoconductor 10. In this type of lubricant application device, the brush roller 29 scrapes the solid lubricant into powder and applies the powdered lubricant to the surface of the photoconductor 10. Further, in the lubricant application device configured to apply the lubricant to the surface of the photoconductor 10 by using the brush roller 29, an application blade may be provided downstream of the brush roller 29 in the surface moving direction of the photoconductor 10 to come into contact with the surface of the photoconductor 10. The application blade, which is supported by an application blade holder such that a leading edge portion of the application blade is in contact with the surface of the photoconductor 10, levels the lubricant applied to the surface of the photoconductor 10 into a uniform thickness.

The charging device 40 is configured to mainly include a charging roller 41 arranged to be in contact with the photoconductor 10 and a charging roller cleaner 42 that rotates while in contact with the charging roller 41.

The development device 50 supplies toner to the surface of the photoconductor 10, so as to visualize the electrostatic latent image that is formed on the surface, and is configured to mainly include a development roller 51, a mixing screw 52, and a supplying screw 53. The development roller 51 serves as a developer carrying member that carries a developer on a surface thereof. The mixing screw 52 conveys the developer contained in a developer container while mixing the developer. The supplying screw 53 conveys the mixed developer while supplying the developer to the development roller 51.

Each of the four process cartridges 121 having the above-described configuration can be independently attached, detached, and replaced by a service technician or user. Further, the process cartridge 121 detached from the printer 100 is configured to allow each of the photoconductor 10, the charging device 40, the development device 50, and the cleaning device 30 to be independently replaced with a new replacement member. The process cartridge 121 may include a waste toner tank for collecting the post-transfer residual toner collected by the cleaning device 30. In this case, if the process cartridge 121 is configured to allow the waste toner tank to be independently attached, detached, and replaced, convenience is improved.

A description will now be given of the operation of the printer 100.

Upon receipt of a print instruction from an external device, such as a not-illustrated operation panel or personal computer, the printer 100 first rotates the photoconductor 10 in the direction indicated by an arrow A in FIG. 2, and causes the charging roller 41 of the charging device 40 to uniformly charge the surface of the photoconductor 10 to a predetermined polarity. The respective charged photoconductors 10 are then applied by the exposure device 140 with, for example, laser beams for the respective colors optically modulated in accordance with input color image data. Thereby, electrostatic latent images corresponding to the respective colors are formed on the respective surfaces of the photoconductors 10. Each of the electrostatic latent images is supplied with a developer of the corresponding color from the development roller 51 of the development device 50 for the color. Thereby, the electrostatic latent images corresponding to the respective colors are developed by the developers of the respective colors and visualized as toner images corresponding to the respective colors. Then, the primary transfer rollers 161 are applied with a transfer voltage opposite in polarity to the toner images. Thereby, a primary transfer electric field is formed between the photoconductors 10 and the primary transfer rollers 161 via the intermediate transfer belt 162. Further, the primary transfer rollers 161 bring the intermediate transfer belt 162 into weak pressure contact with the photoconductors 10 to form respective primary transfer nips. Due to the above-described functions, the respective toner images on the photoconductors 10 are efficiently primarily transferred onto the intermediate transfer belt 162. Consequently, the toner images of the respective colors formed on the photoconductors 10 are transferred onto the intermediate transfer belt 162 to be superimposed on one another, and a laminated toner image is formed.

By contrast, a transfer sheet stored in one of the sheet storing cassettes 131 is fed at predetermined timing by the corresponding sheet feeding roller 132, the registration roller pair 133, and so forth. Then, the secondary transfer roller 165 is applied with a transfer voltage opposite in polarity to the laminated toner image primarily transferred onto the intermediate transfer belt 162. Thereby, a secondary transfer electric field is formed between the intermediate transfer belt 162 and the secondary transfer roller 165 via the transfer sheet, and the laminated toner image is transferred onto the transfer sheet. The transfer sheet having the laminated toner image transferred thereto is then conveyed to the fixing device 90, and the toner image is fixed on the transfer sheet with head and pressure applied thereto. The transfer sheet having the toner image fixed thereon is discharged to and placed on the discharged sheet storing unit 135 by the sheet discharging rollers. Meanwhile, post-transfer residual toner remaining on each of the photoconductors 10 after the primary transfer operation is scrapped off and removed by the blade member 5 of the corresponding cleaning device 30.

A detailed description will be given of the cleaning device 30 shown in FIGS. 3 and 4.

Figure 3:
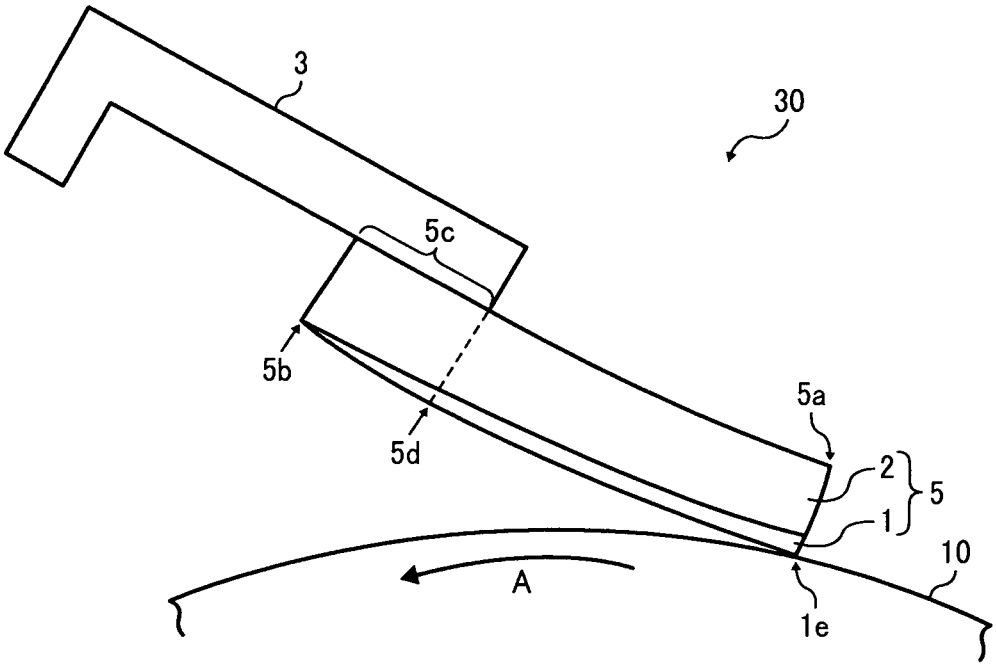
FIG. 3 is a diagram of a portion of a blade member of a cleaning device according to an embodiment of the present invention in contact with a photoconductor.

FIG. 3 is an explanatory diagram illustrating a portion of the blade member 5 of the cleaning device 30 in contact with the photoconductor 10, as viewed in the direction of the rotation axis of the photoconductor 10. FIG. 4 is an explanatory diagram illustrating the blade member 5 and the blade holder 3 of FIG. 3.

The cleaning device 30 includes the laminated blade member 5 and the blade holder 3 holding one edge of the blade member 5. The blade member 5 is formed by two layers, which include an edge layer 1 and a backing layer 2 made of materials mutually different in permanent set value. The cleaning device 30 cleans the surface of the photoconductor 10 by bringing an edge portion 1*e* of the blade member 5 opposite to a side of the blade member 5 held by the blade holder 3 into contact with the surface of the photoconductor 10 moving in the direction indicated by arrow A in FIG. 3. The edge layer 1 including the edge portion 1*e* is made of a material higher in permanent set value than the material forming the backing layer 2.

The blade member 5 of the cleaning device 30 according to this embodiment further includes a blade leading edge 5*a* that is one edge of the blade member 5 where the edge portion 1*e* is formed, a blade trailing edge 5*b* that is an opposite edge of the blade member 5, a blade holding portion 5*c* where the blade holder 3 holds the blade member 5, and a holder leading edge 5*d* that is a leading edge of the blade holding portion 5*c* toward the blade leading edge 5*a*.

In the cleaning device 30, a ratio of a layer thickness E of the edge layer 1 to a layer thickness B of the backing layer 2 at the blade trailing edge 5*b* is smaller than a ratio of the layer thickness E of the edge layer 1 to the layer thickness B of the backing layer 2 at the blade leading edge 5*a*. Specifically, the ratio of the layer thickness E of the edge layer 1 to the layer thickness B of the backing layer 2 is at its maximum at the blade leading edge 5*a* and gradually tapers (becomes smaller) toward the blade trailing edge 5*b*.

In order to facilitate an understanding of the novel and non-predictable advantages of the present invention according to the present embodiment, a comparative example is now described.

Figure 5:
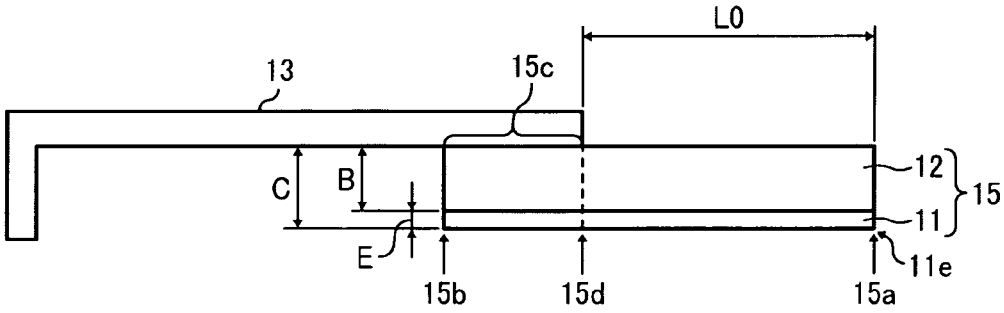
FIG. 5 is a diagram of a comparative example of a blade holder and a double-layer laminated blade member of a generally used cleaning device.

FIG. 5 illustrates a schematic view of a comparative example of a blade member provided in a generally used cleaning device. FIG. 5 is a diagram of a double-layer laminate-structured blade member 15 and a blade holder 13 holding the blade member 15. The blade member 15 includes an edge layer 11 made of an elastic material of relatively high hardness and a backing layer 12 made of an elastic material of relatively low hardness.

In the blade member 15 illustrated in FIG. 5, the edge layer 11 having a relatively high permanent set value extends over an entire area from a holding portion 15*c* held by the blade holder 13 to the leading edge 15*a* of the blade member 15 on the side of an edge portion 11*e*. Therefore, in a state in which the blade member 15 is pressed and flexed against a cleaning target, not only the backing layer 12 that is relatively resistant to the loss of resilience but also the edge layer 11 that is relatively susceptible to the loss of resilience is flexed. If the blade member 15 is kept in continuous contact with the cleaning target for an extended period of time, therefore, a substantial loss of resilience may occur only in the edge layer 11.

If the loss of resilience occurs in the edge layer 11, the edge layer 11 tends to maintain the flexed shape thereof. As a result, the backing layer 12 with little or no loss of resilience receives force acting in the flexing direction. Therefore, the change over time in contact state occurs more easily than in the single-layer structured blade member made solely of the same material as the material forming the backing layer 12.

In the laminated blade member 15 as illustrated in FIG. 5, the edge layer 11 is made of a material having a relatively high permanent set value, and the backing layer 12 is made of a material having a relatively low permanent set value. This is because, if a blade member is made solely of a material having relatively high hardness and a relatively high permanent set value suitable for use in the edge layer 11, the loss of resilience occurs in the blade member, and thus the blade member fails to maintain stable linear pressure over time or due to environmental changes. The blade member 15 illustrated in FIG. 5, therefore, is configured to use a material having relatively low hardness and a relatively low permanent set value in the backing layer 12 to prevent the loss of resilience occurring throughout the entire blade member 15.

Even in the configuration including the edge layer 11 extending over the entire area from the blade leading edge 15*a* to the blade trailing edge 15*b* on the side of the edge portion 11*e*, as illustrated in FIG. 5, it is possible to attain both relatively high contact pressure and maintenance of the initial contact state, depending on the combination of materials forming the edge layer 11 and the backing layer 12. In this configuration, however, the ratio of the thickness of the edge layer 11 to the thickness of the backing layer 12 is substantially constant from the blade leading edge 15*a* toward the blade holding portion 15*c*. With this configuration, when the edge layer 11 made of a material having a relatively high permanent set value is used, characteristics of the edge layer 11 having a relatively high permanent set value may greatly affect the blade holding portion 15*c*, which is essentially unnecessary. As a result, the loss of resilience of the entire blade member 15 cannot be improved sufficiently, and freedom to combine materials for the laminated structure is limited.

As a method of manufacturing the blade member 15 used in a configuration that removes small-diameter or spherical toner particles by using a material of relatively high hardness in the edge portion 11*e* forming the blade leading edge 8*a*, different materials may be subsequently mixed in a centrifugal molding machine for forming a laminated structure. In this case, however, the edge layer 11 of relatively high hardness is formed not just in a leading edge portion of the blade member 15, which essentially requires the edge layer 11, but in the entire area from the holding position 15*c* to the leading edge 15*a* of the blade member 15 on the side of the edge portion 11*e*, as illustrated in FIG. 5. Consequently, the loss of resilience occurs in the edge layer 11, and causes a reduction in linear pressure.

As illustrated in FIG. 5, the ratio of the thickness of the edge layer 11 to the thickness of the backing layer 12 from the blade leading edge 15*a* to the blade trailing edge 15*b* on the blade member 15 is substantially constant. In this case, not only the blade leading edge 5*a*, which is essential, but also a layer made of a material relatively high in hardness is less required, and therefore, characteristics of the edge layer 11 made of a material having a relatively high permanent set value greatly affects the blade holding portion 15*c* where the stress on the blade member 15 concentrates. This can easily cause the loss of resilience on the edge layer 11 at the holder leading edge 15*d*, and the loss of resilience on the edge layer 11 leads to linear pressure reduction.

Figure 4:
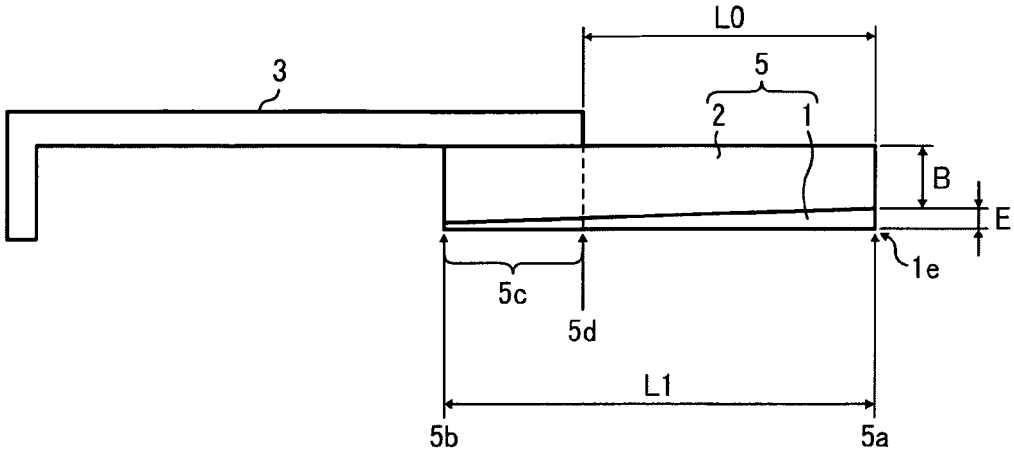
FIG. 4 is a diagram of the blade member and a blade holder included in the cleaning device according to the embodiment.

By contrast, the configuration of the blade member 5 of the cleaning device 30 according to this embodiment illustrated in FIGS. 3 and 4 can prevent occurrence of the loss of resilience as a beam for a portion other than the blade leading edge 5*a*, which is not essential. By forming the blade member 5 to have a reduced ratio of the thickness of the edge layer 1 to the thickness of the backing layer 2 from the blade leading edge 5*a* toward the blade holding portion 5*c*, occurrence of permanent set of the edge layer 1 can be prevented. That is, with the ratio of the thickness of the edge layer 1 to the thickness of the backing layer 2 gradually tapered toward the blade leading edge 5*d* where the stress on the blade member 5 concentrates, when the blade member 5 is pressed against the photoconductor 10 as illustrated in FIG. 3 occurrence of permanent set as the beam of the edge layer 1 can be prevented. Accordingly, while the edge portion 1*e* maintains its required properties, the loss of resilience depending on the characteristics of the edge layer 1 can be reduced substantially.

Consequently, in the cleaning device 30 according to this embodiment, even if the edge layer 1 where the edge portion 1*e* is formed uses a material having a permanent set value of approximately 2% or higher, the backing layer 2 uses a material having a permanent set value of approximately 0.2% or lower and the essential portion of the blade leading edge 5*a* uses a material of high hardness having a higher permanent set to reduce the ratio of the edge layer 1 using a material of high hardness having a higher permanent set at the holder leading edge 5*d* that is a boundary between the free length portion and the blade holding portion 5*c* where the stress on the blade member 5 concentrates, so that the ratio of the backing layer 2 using a material having a lower permanent set value can increase. With this configuration, the blade member 5 is capable of maintaining favorable cleaning performance for cleaning off polymerized toner including small-diameter spherical toner particles for a relatively long time from the initial state, without losing resilience.

The blade member 5 illustrated in FIG. 4 satisfies a relation of L1>L0, where a free length of the blade member 5 is L0 and L1 is a length of the edge layer 1, which in this case is equal to the total length of the blade member 5. In addition, the backing layer 2 has a thickness that increases from the blade leading edge 5*a* toward the blade holding portion 5*c* and the edge layer 1 has a thickness that decreases from the blade leading edge 5*a* toward the blade holding portion 5*c*. That is, a relation between a thickness E of the edge layer 1 and a thickness B of the backing layer 2 from the blade leading edge 5*a* toward the blade holding portion 5*c* up to the blade trailing edge 5*b* satisfies "E/(E+B)". According to this configuration, impact on the edge layer 1 at the blade holding portion 5*c* and the blade trailing edge 5*b* can be smaller than impact on the edge layer 1 at the blade leading edge 5*a*.

Figure 6:
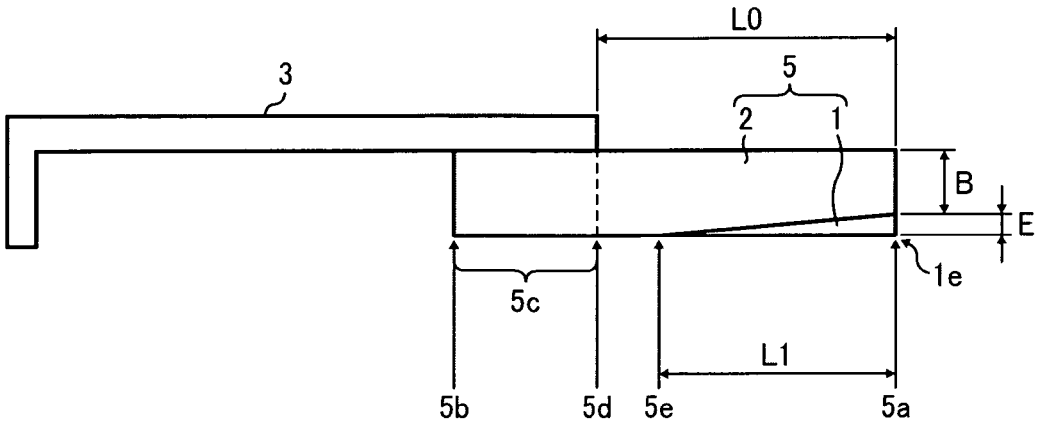
FIG. 6 is another configuration of a blade member and a blade holder included in the cleaning device according to the embodiment.

FIG. 6 is a diagram of an improved configuration of the blade member 5 of FIG. 4.

The blade member 5 illustrated in FIG. 6 is different from the blade member 5 illustrated in FIG. 4 in that the blade member 5 illustrated in FIG. 6 satisfies a relation of L1<L0, so that the edge layer 1 is not formed on the blade holding portion 5*c* where the stress on the blade member 5 concentrates. Compared with the configuration of the blade member 5 illustrated in FIG. 4, the configuration of the blade member 5 illustrated in FIG. 6 can further reduce impact on the edge layer 1 at the blade holding portion 5*c*. Therefore, when compared with the blade member 5 illustrated in FIG. 4, the blade member 5 illustrated in FIG. 6 can further prevent the loss of resilience depending on the characteristics of the edge layer 1.

Preferably, the length L1 of the edge layer 1 is 100 μm or greater. Since the length of the contact surface of the blade member 5 and the photoconductor 10 is approximately 100 μm, if the length L1 of the edge layer 1 is smaller than 100 μm, toner removal performance may deteriorate.

The edge layer 1 in contact with the photoconductor 10 uses a material having a permanent set value of approximately 2% or higher and a relatively high 100% modulus value and the backing layer 2 uses a material having a permanent set value of approximately 0.2% or lower. The thickness E of the edge layer 1 and the thickness B of the backing layer 2 are adjusted so that the permanent set value of a combination of the edge layer 1 and the backing layer 2 is 2% or lower.

Further, in the setting of a contact depth "d" (mm), a contact pressure "f" (g/cm), a contact angle "a" (degree), and so forth of the blade member 5 with respect to the photoconductor 10, physical properties of the materials forming the blade member 5 combining the edge layer 1 and the backing layer 2 may be measured, and the setting may be performed on the basis of the measured physical properties. For example, the contact depth "d", the contact pressure "f", and the contact angle "α" may be set to respective appropriate values in ranges of $0<d<1.5$, $10\leq f\leq 80$, and $5\leq\alpha\leq 25$, respectively. Specific embodiments of the double-layer blade member 5 include Blades 6 and 7 presented in an experiment described later.

Experiment

Subsequently, a description is given of results of an experiment carried out by the present inventors.

In the present experiment, multiple blade members having different types of configurations were prepared, and each of the blade members was kept in contact with a photoconductor for a predetermined long time to examine the degree of reduction over time in linear pressure with respect to the initial linear pressure.

TABLE 1 lists the respective configurations of Blades 1 to 7, i.e., seven types of blade members used in the experiment.

TABLE 1

| | | ENTIRETY | | EDGE LAYER | | BACKING LAYER | |
|---|---|---|---|---|---|---|---|
| BLADE NO. | CONFIGURATION | 100% M [Mpa] | PERMANENT SET [%] | 100% M [Mpa] | PERMANENT SET [%] | 100% M [Mpa] | PERMANENT SET [%] |
| 1 | SINGLE | 4 | 1 | — | — | — | — |
| 2 | SINGLE | 5.3 | 2.1 | — | — | — | — |

TABLE 1-continued

| BLADE NO. | CONFIGURATION | ENTIRETY 100% M [Mpa] | ENTIRETY PERMANENT SET [%] | EDGE LAYER 100% M [Mpa] | EDGE LAYER PERMANENT SET [%] | BACKING LAYER 100% M [Mpa] | BACKING LAYER PERMANENT SET [%] |
|---|---|---|---|---|---|---|---|
| 3 | SINGLE | 6.2 | 2.3 | — | — | — | — |
| 4 | SINGLE | 12 | 4.8 | — | — | — | — |
| 5 | DOUBLE | — | 1.95 | 12 | 4.8 | 3 | 0.85 |
| 6 | MOD. DOUBLE | — | 1.65 | 12 | 4.8 | 3 | 0.85 |
| 7 | MOD. DOUBLE | — | 1.2 | 12 | 4.8 | 3 | 0.85 |

Herein, "SINGLE", "DOUBLE", and "MOD. DOUBLE" in the column of CONFIGURATION represent the single-layer structure, the double-layer structure, and the modified double-layer structure, respectively.

Figure 7:
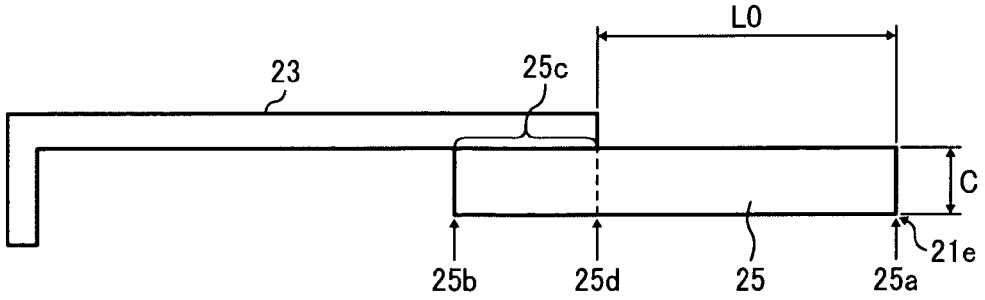
FIG. 7 is a diagram of another comparative example of a single-layer blade member and a blade holder of a generally used cleaning device.

FIG. 7 illustrates a schematic view of another comparative example of a blade member 25 provided in a generally used cleaning device and used for Blades 1 through 4 having a single-layer structure shown in TABLE 1. Blades 1 through 4 in TABLE 1 have a thickness C of approximately 1.8 mm and a free length L0 of approximately 7.2 mm.

The blade member 25 illustrated in FIG. 7 includes an edge portion 21*a* and is supported by a blade holder 23 at a blade holding portion 25*c*. The blade member 25 includes a blade leading edge 25*a*, blade trailing edge 25*b*, and a holder leading edge 25*d*. The configuration of the blade member 25 illustrated in FIG. 7 is similar to the blade member 15 illustrated in FIG. 5, except that the blade member 25 includes a single-layer structure while the blade member 15 includes a laminated structure.

Further, as illustrated in FIG. 5, Blade 5 having a double-layer structure in TABLE 1 has a constant ratio between thicknesses of the edge layer 11 and the backing layer 12. That is, the thickness E of the edge layer 11 is approximately 0.5 mm and a thickness B of the backing layer 12 is approximately 1.3 mm, an entire blade thickness C is approximately 1.8 mm, and a free length L0 is approximately 7.2 mm. As illustrated in TABLE 1, the permanent set value of the entire blade is approximately 1.95% in Blade 5.

Blades 6 and 7 in TABLE 1 have a modified double-layer structure according to an embodiment of the present invention.

Blade 6 having a modified double-layer structure in TABLE 1 uses the blade member 5 illustrated in FIG. 4. That is, the thickness E of the edge layer 1 is approximately 0.5 mm at the blade leading edge 5*a*, the thickness B of the backing layer 2 is approximately 1.3 mm, the free length L0 is approximately 7.2 mm, the length L1 of the edge layer 1 is approximately 12 mm, and the thickness of E of the edge layer 1 is 0 mm at the blade trailing edge 5*b*.

Blade 7 having a modified double-layer structure in TABLE 1 uses the blade member 5 illustrated in FIG. 6. That is, the thickness E of the edge layer 1 is approximately 0.5 mm at the blade leading edge 5*a*, the thickness B of the backing layer 2 is approximately 1.3 mm, the free length L0 is approximately 7.2 mm, and the length L1 of the edge layer 1 is approximately 4 mm.

In comparison with Blades 5, 6, and 7 using the same material on the edge layer 1 in TABLE 1, the permanent set values decrease in order of Blades 7, 6, and 5, which proves the permanent set value is enhanced. A decrease in ratio of the edge layer 1 using a material having a relatively high permanent set value has achieved this enhancement.

Each of Blades 1 to 7 illustrated in TABLE 1 was left in an image forming unit for 240 hours while in contact with a photoconductor. In the meantime, chronological data of the acting force (i.e., linear pressure) of the blade member was measured. Further, deformed toner cleaning performance and spherical toner cleaning performance of the blade member were also checked. The results of the measurements are listed in TABLE 2.

TABLE 2

| BLADE NO. | LINEAR PRESSURE REDUCTION RATE [%] | INITIAL STATE DEFORMED TONER | INITIAL STATE SPHERICAL TONER | 80K STATE DEFORMED TONER | 80K STATE SPHERICAL TONER |
|---|---|---|---|---|---|
| 1 | 97.7 | GOOD | POOR | GOOD | POOR |
| 2 | 92 | GOOD | POOR | GOOD | POOR |
| 3 | 88.5 | GOOD | GOOD | GOOD | POOR |
| 4 | 78 | — | GOOD | — | POOR |
| 5 | 91.4 | — | GOOD | — | GOOD |
| 6 | 93.2 | — | GOOD | — | GOOD |
| 7 | 96.5 | — | GOOD | — | GOOD |

Figure 8:
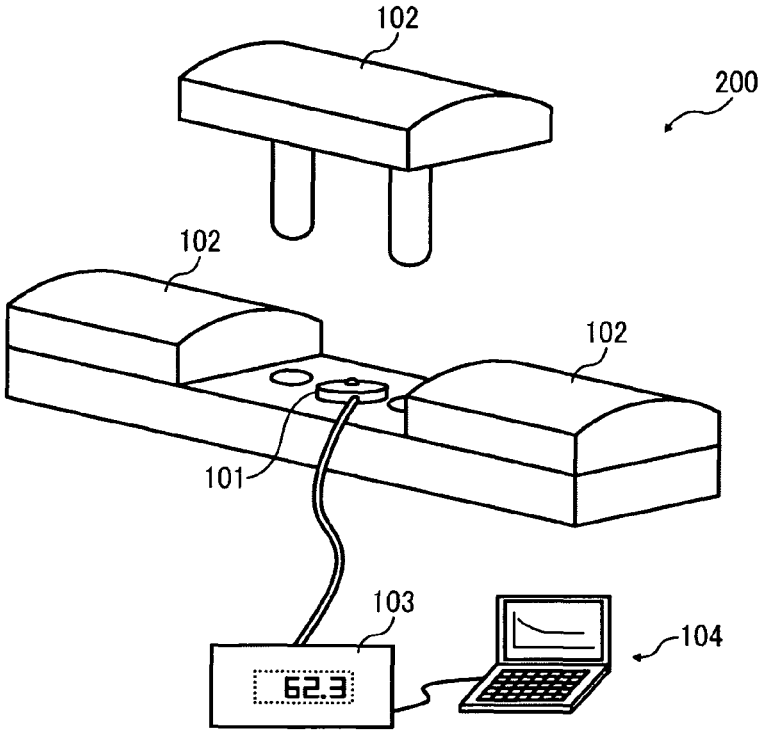
FIG. 8 is a perspective view of a measurement device.
Figure 9:
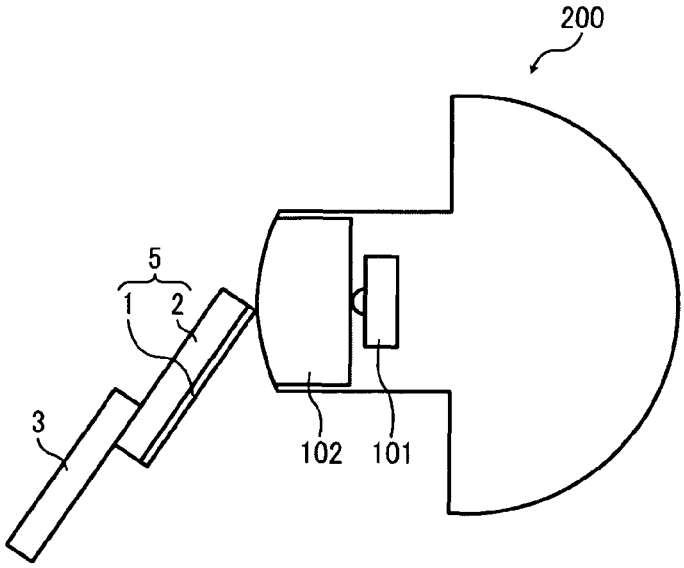
FIG. 9 is a side view of the measurement device.
Figure 10:
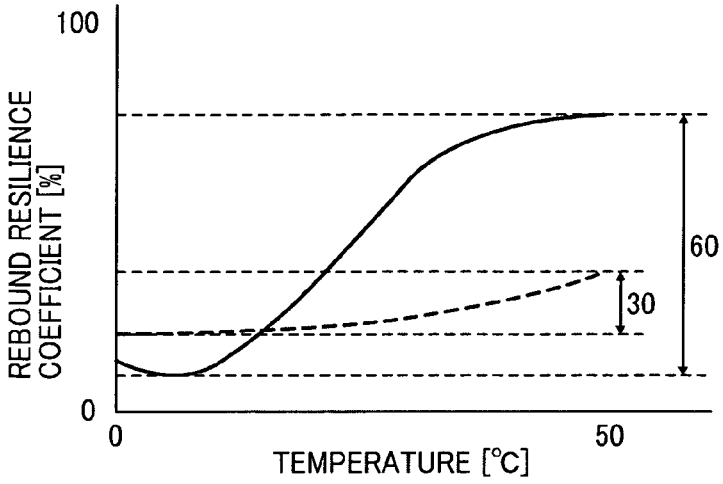
FIG. 10 is a graph of profiles of changes in rebound resilience coefficient caused by temperature changes.

FIGS. 8 and 9 are explanatory diagrams of a measuring device 200 that measures the liner pressure.

The measuring device 200, which measures the liner pressure generated by the contact of a blade attached thereto, has a diameter corresponding to the diameter of the photoconductor 10, and includes a pad 102 provided at a location that comes into contact with the edge layer 1 of the blade member 5.

The pad 102 is divided into three sections in the longitudinal direction thereof, and transmits the acting force of the blade member 5 to a load cell 101, which is arranged to be in contact with each of the three sections of the pad 102. The load cell 101 may be, for example, a load cell LMA-A-1ON manufactured by Kyowa Electronic Instruments Co., Ltd.

The measuring device 200 further includes a panel 103 for displaying the force acting on the load cell 101. The panel 103 may be, for example, an instrumentation panel WGA-650 manufactured by Kyowa Electronic Instruments Co., Ltd. Further, a logger 104 for logging with a personal computer is prepared to chronologically record measurement values measured by the load cell 101. Each of the blade members is attached to the measurement device 200 in a layout based on practical usage. As for the recorded measurement values, the initial value, i.e., the measurement value measured after the attachment of the blade member to the measurement device 200 is compared with the measurement value measured after the lapse of a predetermined time. Thereby, the reduction rate of the linear pressure is calculated.

In the illustrated example, the pad 102 used for the measurement is divided into three sections. However, the number of divided sections of the pad 102 may be arbitrarily determined.

The linear pressure reduction rate in TABLE 2 represents the percentage of the linear pressure measured after the lapse of 240 hours to the initial linear pressure, and is the value calculated as (linear pressure measured after the lapse of 240 hours)/(initial linear pressure)×100.

The deformed toner in TABLE 2 is polymerized toner including toner particles having a circularity of approximately 0.96 and a particle diameter of approximately 6 μm, and the spherical toner in TABLE 2 is polymerized toner including toner particles having a circularity of at least approximately 0.98 and a particle diameter of approximately 4 μm.

Further, the cleaning performance of the individual blade was determined in the initial state and the 80K state in TABLE 2. In the initial state, the determination was made on samples of the 1st to 1,000th fed sheets. In the 80K state, the determination was made on samples of the 79,001st to 80,000th sheets among 80,000 fed sheets.

In the determination of the cleaning performance, "GOOD" indicates that there is no cleaning failure visible on sheets, and "POOR" indicates that there is a cleaning failure visible on sheets.

As illustrated in TABLE 2, among Blades 1 through 4, which are single-layer blade members, Blades 1 and 2 relatively low in permanent set value have linear pressure reduction rates of approximately 97.7% and approximately 92%, respectively. That is, it was confirmed that the reduction in linear pressure is minimized in Blades 1 and 2. By contrast, in Blades 3 and 4 having relatively high in permanent set value, the linear pressure is reduced over time to linear pressure reduction rates of approximately 88.5% and approximately 78%, respectively. That is, so-called loss of resilience occurs in Blades 3 and 4.

Each of Blades 1 and 2 has a permanent set value of approximately 2.0% or lower, and is made of a material relatively low in permanent set value. Thus, the amount of reduction in linear pressure is relatively small in Blades 1 and 2, and Blades 1 and 2 maintain the deformed toner cleaning performance for a relatively long time, and exhibit favorable deformed toner cleaning performance in the 80K state. Blades 1 and 2, however, have 100% modulus values of approximately 4 MPa (MegaPascals) and approximately 5.3 Mpa, respectively, which are not sufficiently high. Therefore, Blades 1 and 2 fail to obtain sufficiently high contact pressure at the nip portion in which the leading edge 5*a* of the blade member 5 and the photoconductor 10 come into contact with each other, and are unable to clean the spherical toner in the initial state.

Blade 3 has a slightly higher permanent set value of approximately 2.3% and a linear pressure reduction rate lower than 90%, and a slight loss of resilience occurs in Blade 3. Blade 3, however, has a 100% modulus value of approximately 6.2 Mpa, and is made of a relatively high modulus material. Therefore, Blade 3 obtains favorable deformed toner cleaning performance in the 80K state. Blade 3 further obtains favorable spherical toner cleaning performance in the initial state.

Blade 5 uses the material of Blade 4 in the edge layer 1 thereof and uses a material having a relatively low permanent set value in the backing layer 2 thereof. By using those materials, the permanent set value of the entire double-layer structure was improved to approximately 1.95% in Blade 5. The measurement result of the linear pressure reduction rate is approximately 91.4% in Blade 5. In Blade 5, the reduction over time in linear pressure is prevented, and a linear pressure reduction rate of approximately 90% or higher is maintained.

Further, the edge layer 1 of Blade 5 has relatively high 100% modulus values of approximately 12 Mpa. Therefore, Blade 5 is capable of easily obtaining relatively high contact pressure, and thus obtains sufficient spherical toner cleaning performance in the initial state. Further, the permanent set value of the entire blade is set not to exceed approximately 2.0%. Therefore, Blade 5 maintains the spherical toner cleaning performance for a relatively long time, and obtains favorable spherical toner cleaning performance in the 80K state.

Blades 6 and 7 have the configurations according to the present invention and the permanent set values thereof are enhanced as described in TABLE 1. The linear pressure reduction rates of Blades 6 and 7 are also enhanced as compared with Blade 5. Further, the cleaning performance of Blade 7 in the permanent set value and the linear pressure reduction rate is substantially similar to that of Blade 1. However, while Blade 1 fails to clean the spherical toner, the spherical toner cleaning performance of Blade 7 is successful.

According to the results of the above-described experiment, even if a material having a permanent set value exceeding approximately 2% and a relatively high 100% modulus value is used in the edge layer 1, a material having a permanent set value of approximately 2% or lower may be used in the backing layer 2. Further, even if a material having a relatively high permanent set value and a relatively high 100% modulus value is used in the blade leading edge 5*a* that is essential, a laminated structure that reduces the ratio of the thickness of the edge layer 1 to the thickness of the backing layer 2 from the blade leading edge 5*a* across the blade trailing edge 5*b* may be employed, as illustrated in FIGS. 4 and 6. Furthermore, the entire blade member 5 may set a permanent set value of 2% or lower. By so doing, the increase in permanent set value and the reduction in linear pressure can be prevented, thereby maintaining a preferable cleaning performance for a relatively long time.

Further, if a material having a 100% modulus value of approximately 6 Mpa or higher and capable of providing relatively high contact pressure is used in the edge layer 1, the cleaning failure in cleaning polarized toner including small-diameter spherical toner particles, which are herein assumed to have a circularity of approximately 0.98 or higher and a particle diameter of approximately 4 μm, can be prevented.

Further, preferably the blade member 5 of the present embodiment minimizes variations in viscoelasticity of the edge layer 1 caused by environmental variations. Therefore, a rubber material having small variations in rebound resilience coefficient is used as the rubber material forming the edge layer 1.

FIG. 8 schematically illustrates profiles of changes in rebound resilience coefficient caused by temperature changes, with a solid line indicating the profile of changes of a rubber material that has been used in a background blade member, and a broken line indicating the profile of changes of a rubber material used in the edge layer 1 of the blade member 5 according to the present embodiment. In the profile of changes of the rubber material indicated by the solid line, the rebound resilience coefficient changes by approximately 60% between a temperature of 0 degree Celsius and a temperature of 50 degrees Celsius. By contrast, in the profile of changes of the rubber material used in the edge layer 1 of the present embodiment, which is indicated by the broken line, the change in the rebound resilience coefficient between a temperature of 0 degree Celsius and a temperature of 50 degrees Celsius is held to approximately 30%.

The toner removal performance and the durability affected by blade abrasion are substantially affected by the rebound resilience coefficient of the rubber material used in an edge portion of the blade member. In the case of the rubber material that has been used in the background blade member, which is indicated by the solid line, the rebound resilience coefficient substantially varies with temperature. Therefore, toner removal performance is substantially changed or degraded with temperature. Further, characteristics of the blade member also tend to change with temperature, exhibiting substantial variation in durability or life depending on the temperatures at which the blade member is used.

If the durability or life of the blade member varies with temperatures at which the following issue arises. That is, in a configuration allowing integral replacement of the blade member and the other components as a photoconductor unit, as in the process cartridge 121, if deterioration of the durability or a reduction in the life of the blade member is caused by the temperatures at which the blade member is used, there arises a need to replace the photoconductor unit even though the other components might not need replacement. Conversely, if improvement of the durability or an increase in the life of the blade member is caused by the temperatures at which the blade member is used, there arises a need to replace the photoconductor in accordance with the life of the other components even though the blade member is still usable.

By contrast, if a material having small variations in rebound resilience coefficient caused by temperature changes, as indicated by the broken line in FIG. 8, is used as the rubber material forming the edge layer 1, toner removal performance remains stable even in the face of environmental variations, with little variation in durability caused by the temperatures at which the blade member is used. Accordingly, the life of the blade member 5 can be easily adjusted to match the life of the other components forming the photoconductor unit.

In addition to this reduction of changes in rebound resilience coefficient of the edge layer 1 caused by temperature changes, as in the edge layer 1, a material having small variations in rebound resilience coefficient caused by temperature changes is also used in the backing layer 2, even though the material used in the backing layer 2 is set to be lower in 100% modulus value and permanent set value than the material used in the edge layer 1. Thereby, stable toner removal performance and stable durability are obtained against environmental variations. That is, the smaller the temperature dependence of the rebound resilience coefficient, the more stably the cleaning operation can be performed independently of temperature. Accordingly, stable cleaning performance is maintained over time.

Further, a material having a tan δ peak temperature lower than approximately 10 degrees Celsius is used as the rubber material forming the edge layer 1 or the backing layer 2. Thereby, the edge layer 1 or the backing layer 2 functions as a rubber material even at relatively low temperature environment having a temperature of approximately 10 degrees Celsius, and desired cleaning performance is obtained. Further, if the rubber material having a tan δ peak temperature lower than approximately 10 degrees Celsius is a material having a tan δ peak temperature lower than approximately 5 degrees Celsius, the edge layer 1 or the backing layer 2 functions as a rubber material at temperatures of approximately 5 degrees Celsius or higher. Further, if the rubber material having a tan δ peak temperature lower than approximately 10 degrees Celsius is a material having a tan δ peak temperature lower than approximately −20 degrees Celsius, the edge layer 1 or the backing layer 2 functions as a rubber material in an environment having a temperature of approximately −20 degrees Celsius or higher. Thereby, desired cleaning performance is obtained. That is, the lower tan δ peak temperature of the rubber material used in the edge layer 1 or the backing layer 2 makes it possible to use the material at lower temperatures.

[Modification]

A description will be given of a modified configuration of the blade member 5 in FIGS. 11A and 11B, suitable for the cleaning device 30 according this embodiment of the present invention.

Figure 11A:
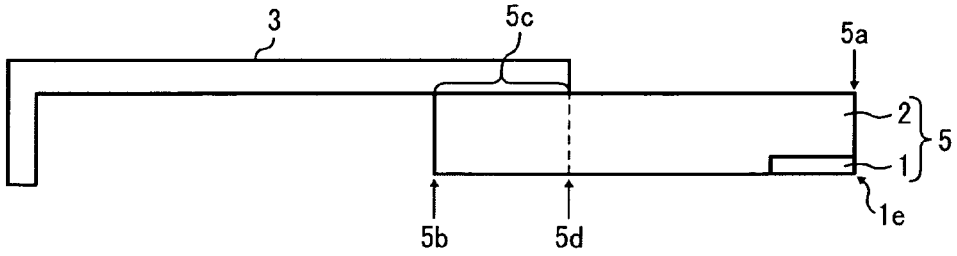
FIGS. 11A and 11B are diagrams of other examples of a blade holder and a blade member including an edge layer only in a leading edge portion thereof, FIG. 11A illustrating a configuration of lamination in which only a part of the leading edge portion forms the edge layer, and FIG. 11B illustrating a configuration in which a portion of the edge layer other than a leading edge portion thereof is removed.
Figure 11B:
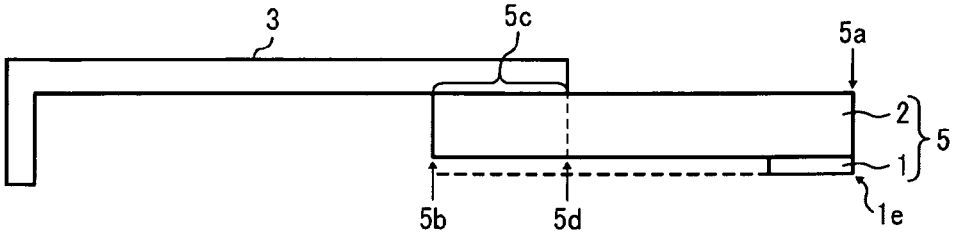

FIG. 11A is a diagram of a configuration of lamination in which only a part in a vicinity of the blade leading edge 5*a* of the blade member 5 forms the edge layer 1, and FIG. 11B is a diagram of a configuration in which a portion of the edge layer other than the blade leading edge 5*a* of the blade member 5 is removed.

The blade members 5 illustrated in FIGS. 4 and 6 are suitable for the cleaning device 30 according to the above-described embodiment and the ratio of the thickness E of the edge layer 1 to the thickness B of the backing layer 2 sequentially decreases from the blade leading edge 5*a* toward the blade holding portion 5*c*.

A configuration in which the ratio of the thickness E of the edge layer 1 to the thickness B of the backing layer 2 of the holder leading edge 5*d* of the blade holding portion 5*c* is smaller than the ratio of the blade leading edge 5*a* of the blade member 5 is not limited to the configuration in which the edge layer 1 decreases sequentially. For example, the configurations of the modification illustrated in FIGS. 11A and 11B are also applicable.

In the above-described embodiments, the cleaning device 30 that includes the laminated blade member 5 including the edge layer 1 having a relatively high permanent set value and the backing layer 2 having a relatively low permanent set value is configured to remove foreign matter adhering to a surface of the photoconductor 10 as a cleaning target. The cleaning target cleaned by a cleaning device including a blade member similar to the blade member 5 of the present embodiment is not limited to the photoconductor. For example, a blade member similar to the blade member 5 may be used as a cleaning member of the intermediate transfer belt cleaning device 167 for cleaning the intermediate transfer belt 162 as the cleaning target. Further, the cleaning target is not limited to the toner image carrying member, such as the photoconductor 10 and the intermediate transfer belt 162. Thus, a blade member similar to the blade member 5 may be used as a cleaning member of a cleaning device for cleaning a recording medium conveying belt, which conveys a recording medium having an untransformed toner image formed thereon, as the cleaning target. Further, the image forming apparatus including the recording medium conveying belt is not limited to the electrophotographic image forming apparatus. Thus, a blade member similar to the blade member 5 may be used as a cleaning member of a cleaning device for cleaning the recording medium conveying belt included in an inkjet image forming apparatus.

Further, the blade member 5, which is configured to come into contact with the photoconductor 10 in accordance with a counter method in the present embodiment, may alternatively employ a trailing method as the contact method.

As described above, the cleaning device 30 of the present embodiment includes the laminated blade member 5 including multiple layers, each of which is made of materials different in permanent set value and the blade holder 3 that holds a distal edge of the laminated blade member 5. The cleaning device 30 cleans a surface of the photoconductor 10, i.e., a moving surface of a cleaning target, by bringing the proximal edge portion 1*e* of the edge layer 1 of the blade member 5, which corresponds to a leading end ridgeline portion on the other end of the blade member 5, is brought into contact with the surface of the photoconductor 10. The multiple layers include the edge layer 1 formed of a material higher in permanent set value than the backing layer 2 disposed against a distal surface of the edge layer 1 and formed of a material having a different type in permanent set value. In the above-described cleaning device 30, the blade member 5 includes the blade leading edge 5*a* on which the edge portion 1*e* thereof is located and the blade trailing edge 5*b* where the blade holder 3 supports the blade member 5. A ratio of the thickness E of the edge layer 1 to the thickness B of the backing layer 2 at the blade holding portion 5*c* of the blade member 5 is formed in a gradually tapered shape than a ratio of the thickness E of the edge layer 1 to the thickness B of the backing layer 2 at the blade leading edge 5*a* where the edge portion 1*e* of the blade member 5 is formed. By forming the thickness E of the edge layer 1 on the side of the blade leading edge 5*a* greater than the thickness E thereof on the side of the blade holding portion 5*c*, deformation of the blade member 5 at the edge portion 1*e* can be reduced, thereby minimizing the increase of the contact area so as to set a relatively high contact pressure. Further, by forming the thin thickness E of the edge layer 1 on the side of the holder leading edge 5*d* where the loss of resilience can easily occur, the loss of resilience than the thickness E thereof on the side of the blade holding portion 5*c*, the characteristic of the edge layer 1 using a material having a relatively high permanent set value at the holder leading edge 5*d* where the loss of resilience most occurs can be reduced, and thus the occurrence of the loss of resilience can be prevented. Therefore, the occurrence of the loss of resilience of the blade member 5 can be minimized as compared to a related-art laminated blade member, thereby maintaining the initial contact state as compared with a configuration using the related-art blade member.

Further, a related-art blade member used for cleaning pulverized toner and polymerized toner having a low sphericity and a particle diameter of 6 μm or greater uses a single-layer elastic material that has a 100% modulus value of approximately 5 MPa or smaller and a permanent set value of approximately 1.5% or smaller.

By contrast, by using a urethane rubber material having a high rigidity and a relatively high 100% modulus value, the contact pressure at the contact area of the leading edge 5*a* of the blade member 5 to the photoconductor 10 can increase, thereby favorably cleaning off polymerized toner including small-diameter spherical toner particles. In general, however, an elastic material such as a urethane rubber material having a relatively high 100% modulus value has a high permanent set value.

Therefore, if a material having a relatively high 100% modulus value is used for a related-art blade member that has a free length and a single-layer urethane rubber material is held by a metallic holding plate that serves as a blade holding member, the loss of resilience can easily occur. Therefore, the blade member cannot maintain the initial contact state, which has caused a difficulty in maintaining the cleaning performance of the blade member for a long time.

By contrast, in the cleaning device 30 according to the present embodiment, in order to increase the contact pressure in the contact area of the blade member 5 in contact with a cleaning target and thereby clean off polymerized toner including small-diameter spherical toner particles, a material relatively high in hardness and in 100% modulus value is used in the edge layer 1 forming a portion of the blade member 5 in contact with the cleaning target. Herein, it is desired that the edge layer 1 uses a rubber material having a 100% modulus value of approximately 6 MPa or higher.

To prevent the loss of resilience, which is an issue arising in the use of a material having a relatively high 100% modulus value, the rear side of the edge layer 1, i.e., the far side of the edge layer 1 from the cleaning target is provided with the backing layer 2 made of a rubber material different in composition from the rubber material of the edge layer 1. As the material used in the backing layer 2, a material lower in hardness, in 100% modulus value, and in permanent set value than the material of the edge layer 1 is used.

Further, when a related-art laminated blade member having a material relatively high in hardness and in 100% modulus value is used in the edge layer 1 forming a portion of the blade member 5 in contact with the cleaning target, the loss of resilience occurs in the blade member, and thus the blade member fails to maintain stable linear pressure over time or due to environmental changes. In general, if a laminated blade member is formed by a centrifugal molding machine by sequentially putting different materials, the ratio of the thickness of the edge layer 1 to the thickness of the backing layer 2 in a range from the blade leading edge 5*a* to the blade trailing edge 5*b* is constant as illustrated in FIG. 5. In this case, the characteristic of the edge layer 1 that has a relatively highly permanent set value significantly affects not only on an essential blade leading edge 5*a* but also on the blade holding portion 5*c* where a layer with high hardness is not so necessary and the stress of the blade member 5 concentrates. Therefore, the loss of resilience can easily occur on the edge layer 1 at the holder leading edge 5*d*, which can cause a reduction in line pressure.

By contrast, in the blade member 5 of the cleaning device 30 according to the present embodiment, the essential blade leading edge 5*a* uses a material having a relatively high permanent set value and providing a favorable cleaning performance and the backing layer 2 uses a material having a relatively low permanent set value. However, in this lamination, a ratio of the thickness of the edge layer 1 and the thickness of the backing layer 2 is not equal from the blade leading edge 5*a* to the holder leading edge 5*d*. That is, the laminated blade member 5 according to the present invention has a ratio of the thickness of the edge layer 1 to the thickness of the backing layer 2 gradually decreasing from the blade leading edge 5*a* toward the holder leading edge 5*d* of the blade member 5.

With this configuration, the characteristic of a material having a relatively low permanent set value used for the backing layer 2 becomes dominant in the characteristic of the entire lamination. Further, to make the characteristic of the material having a relatively low permanent set value dominant in the holder leading edge 5*d* where the stress of the blade member 5 can easily concentrate and thus can be easily a cause of the loss of resilience, the ratio of a material having a relatively high permanent set value is decreased or the holder leading edge 5*d* is formed as a single-layer structure formed by a material having a relatively low permanent set value, thereby minimizing the reduction in line pressure due to the loss of resilience.

Further, the thickness E of the edge layer 1 and the thickness B of the backing layer 2 are adjusted so that the permanent set value of a combination of the edge layer 1 and the backing layer 2 is 2% or lower. By so doing, the deterioration of the cleaning performance caused by the loss of resilience can be minimized. With this configuration, even if the edge layer 1 of the blade member 5 uses a material having a relatively high permanent set value and a relatively high 100% modulus value, the blade member 5 is capable of maintaining favorable cleaning performance for cleaning off polymerized toner including small-diameter spherical toner particles for a relatively long time from the initial state, without losing resilience.

Further, in the above-described cleaning device 30, the ratio of the thickness E of the edge layer 1 to the thickness B of the backing layer 2 is at its maximum at the blade leading edge 5*a* of the blade member 5 and gradually decreases or tapers toward the holding portion 5*c* of the blade holder 3. That is, as illustrated in FIGS. 4 and 6, the relation between the thickness E of the edge layer 1 and the thickness B of the backing layer 2 from the blade leading edge 5*a* toward the blade holding portion 5*c* up to the blade trailing edge 5*b* satisfies "E/(E+B)". By gradually tapering the relative thickness of the edge layer 1 to the backing layer 2, the stress on the blade member 5 can be prevented from concentrating locally. Therefore, the occurrence of the loss of resilience of the blade member 5 can be prevented, thereby maintaining the initial contact state.

Further, as illustrated in FIG. 6, the edge layer 1 of the blade member 5 is formed closer to the blade leading edge 5*a* than to the blade holding portion 5*c*. That is, the blade member 5 satisfies the relation of "L1<L0", so that the edge layer 1 is not formed on the blade holding portion 5*c* where the stress on the blade member 5 concentrates. Therefore, when compared with the blade member 5 illustrated in FIG. 4, the blade member 5 illustrated in FIG. 6 can further prevent the loss of resilience depending on the characteristics of the edge layer 1.

Preferably, the length L1 of the edge layer 1 is 100 μm or greater. Since the length of the contact surface of the blade member 5 and the photoconductor 10 is approximately 100 μm, if the length L1 of the edge layer 1 is smaller than 100 μm, toner removal performance may deteriorate.

Further, in the above-described cleaning device 30, the edge layer 1 of the blade member 5 including the edge portion 1*e* is made of a material having a 100% modulus value in a range of approximately 6 MPa to approximately 12 MPa at a temperature of 23 degrees Celsius. In this case, the temperature of 23 degrees Celsius is a standard room temperature. By so doing, the contact pressure in the contact area of the blade member 5 against the photoconductor 10 serving as a cleaning target can increase, thereby cleaning off polymerized toner including small-diameter spherical toner particles.

Further, in the above-describe cleaning device 30, the edge layer 1 including the edge portion 1*e* is made of a rubber material in which the difference between maximum and minimum rebound resilience coefficient values across a temperature change range of 0 degree Celsius to 50 degrees Celsius is approximately 30% or less. With this reduction in the temperature dependence of the rebound resilience of the edge layer 1, the changes or deteriorations of the toner removal performance due to the usage environment is prevented, and stable toner removal performance and stable durability are obtained.

Further, the cleaning device 30 uses a rubber material having a tan δ peak temperature lower than approximately 10 degrees Celsius as the material forming the edge layer 1 of the blade member 5. Thereby, even in a relatively low temperature environment having a temperature of approximately 10 degrees Celsius, the edge layer 1 functions as a rubber material and desired cleaning performance can be obtained.

Further, the cleaning device 30 uses, as the material forming the backing layer 2 of the blade member 5, a rubber material in which the difference between the maximum and minimum rebound resilience coefficient values across a temperature change range of 0 degree Celsius to 50 degrees Celsius is approximately 300 or less. Further, the cleaning device 30 uses a rubber material having a tan δ peak temperature lower than approximately 10 degrees Celsius, as the material for forming the backing layer 2. With this reduction in the temperature dependence of the edge layer 1 and the backing layer 2, more stable toner removal performance and more stable durability are obtained.

Further, it is desired to provide the cleaning device 30 with a lubricant application device that applies a lubricant to the surface of the photoconductor 10 as a cleaning target. The lubricant applied to the cleaning target helps to improve the cleaning performance of the blade member 5. Further, with the lubricant applied to the photoconductor 10, the surface of the photoconductor 10 is protected by the lubricant in the charging process performed by the charging device 40. Accordingly, deterioration of the surface of the photoconductor 10 by the charging is minimized.

Further, the printer 100 of the present embodiment transfers, onto a recording medium, an image formed on the moving surface of the photoconductor 10, onto a moving surface of the image transfer belt 162 and then onto a recording medium. The printer 100 includes the process cartridge 121 that is removably installable in the printer 100, and that integrally supports the photoconductor 10 and a cleaning device that removes an unnecessary foreign matter adhering to the surface of the photoconductor 10 as the above-described cleaning target. With the use of the cleaning device 30 of the present embodiment as a cleaning device of the process cartridge 121, the process cartridge 121 is capable of maintaining the initial contact state longer than before and stably cleaning the photoconductor 10 for a relatively long time.

Further, the printer 100 transfers a toner image formed on the photoconductor 10, which is an image carrying member having a moving surface, onto the intermediate transfer belt 162 serving as an intermediate transfer member, and transfers the toner image onto a transfer sheet serving as a recording medium. The printer 100 includes the secondary transfer device 160 serving as an intermediate transfer unit that is removably installable in the body of the printer 100, and that integrally supports the intermediate transfer belt 162 and the intermediate transfer belt cleaning device 167 serving as a cleaning device that removes an unnecessary foreign matter adhering to the surface of the intermediate transfer belt 162 as the cleaning target. By using a cleaning device including a blade member similar to the blade member 5 of the cleaning device 30 as the intermediate transfer belt cleaning device 167, the secondary transfer device 160 is capable of favorably cleaning the intermediate transfer belt 162 for a relatively long time.

Further, the printer 100 is an image forming apparatus that transfers a toner image formed on the photoconductor 10, which is a surface moving member, onto a transfer sheet. With the use of the cleaning device 30 as a cleaning device for removing an unnecessary foreign material adhering to the surface of the photoconductor 10, the photoconductor 10 is favorably cleaned for a relatively long time, and the printer 100 is capable of performing a favorable image forming operation.

Further, the toner forming the toner image in the printer 100 is a polymerized toner including toner particles having a shape factor SF1 in a range of approximately 100 to approximately 150. Some of polymerized toners include substantially spherical toner particles, and are capable of forming a high-quality toner image. To remove such spherical toner particles, however, a high level of removal performance is required. The cleaning device 30 attains both relatively high contact pressure and maintenance of the initial contact state, and thus is capable of favorably cleaning the spherical toner particles requiring a high level of removal performance. Accordingly, the printer 100 is capable of stably forming a high-quality image.

Further, some of image forming apparatuses include a recording medium conveying unit that is removably installable in the image forming apparatus that forms an image on a recording medium carried on a surface of a recording medium conveying belt serving as a recording medium conveying member being a surface moving member, and that integrally supports the recording medium conveying belt and a conveying belt cleaning device for removing an unnecessary foreign matter adhering to the surface of the recording medium conveying belt as the cleaning target. By using a cleaning device including a blade member similar to the blade member 5 of the cleaning device 30 as the conveying belt cleaning device of the thus configured image forming apparatus, the recording medium conveying unit is capable of favorably cleaning the recording medium conveying belt for a relatively long time.

The above-described embodiments are illustrative and do not limit the present invention. Thus, numerous additional modifications and variations are possible in light of the above teachings. For example, elements or features of different illustrative and exemplary embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

The invention claimed is:

1. A cleaning device for cleaning a moving surface of a cleaning target, comprising:

a laminated blade member including multiple layers, each of which is made of materials different in permanent set value, the multiple layers including an edge layer formed of a material higher in permanent set value than any other one of the materials of the multiple layers and a backing layer disposed against a distal surface of the edge layer; and a holding member to hold a distal edge of the laminated blade member, a proximal edge portion of the edge layer of the blade member being brought into contact with the moving surface of the cleaning target, the laminated blade member including a leading edge on which the edge portion thereof is located and a trailing edge where the holding member supports the blade member, a ratio of a thickness of the edge layer to a thickness of the backing layer at the trailing edge of the blade member being smaller than a ratio of the layer thickness of the edge layer to the layer thickness of the backing layer at the leading edge of the blade member, wherein a length of the backing layer from the leading edge of the laminated blade member to the trailing edge of the laminated blade member is equal to or greater than a length of the edge layer from the leading edge of the laminated blade member to the trailing edge of the laminated blade member.

2. The cleaning device according to claim 1, wherein the ratio of the thickness of the edge layer to the thickness of the backing layer is at its maximum at the leading edge of the blade member and gradually tapered toward the trailing edge of the holding member.

3. The cleaning device according to claim 1, wherein the edge layer is formed closer to the leading edge of the blade member than to the blade holding portion.

4. An image forming apparatus comprising the cleaning device according to claim 1.

5. The image forming apparatus according to claim 4, wherein toner particles forming an image have a shape factor SF1 in a range of from approximately 100 to approximately 150.

6. The cleaning device according to claim 1, wherein the edge layer including the edge portion is made of a material having a 100% modulus value in a range of from approximately 6 MPa to approximately 12 MPa at a temperature of 23 degrees Celsius.

7. The cleaning device according to claim 1, wherein the edge layer including the edge portion is made of a material in which the difference between maximum and minimum rebound resilience coefficient values across a temperature change range of from 0 degree Celsius to 50 degrees Celsius is approximately 30% or less.

8. The cleaning device according to claim 1, wherein the material forming the edge layer has a tan δ peak temperature lower than approximately 10 degrees Celsius.

9. The cleaning device according to claim 1, wherein the backing layer disposed against a distal surface of the edge layer is made of a material in which the difference between maximum and minimum rebound resilience coefficient values across a temperature change range of from 0 degree Celsius to 50 degrees Celsius is approximately 30% or less.

10. The cleaning device according to claim 1, wherein the backing layer disposed against the distal surface of the edge layer is made of a material having a tan δ peak temperature lower than approximately 10 degrees Celsius.

11. A process cartridge removably installable in an image forming apparatus that transfers, onto a recording medium, an image formed on a moving surface of a latent image carrying member, wherein the process cartridge supports both the latent image carrying member and the cleaning device according to claim 1 as a single integrated unit.

12. An intermediate transfer unit removably installable in an image forming apparatus that transfers an image formed on a moving surface of an image carrying member onto a moving surface of an intermediate transfer member and then onto a recording medium, wherein the intermediate transfer unit supports both the intermediate transfer member and the cleaning device according to claim 1 as a single integrated unit.

* * * * *